US010935029B2

(12) United States Patent
Kuronuma et al.

(10) Patent No.: US 10,935,029 B2
(45) Date of Patent: Mar. 2, 2021

(54) PUMP AND MOTOR CASING HAVING RIBS AND GUIDE PROTRUSIONS

(71) Applicant: Ebara Corporation, Tokyo (JP)

(72) Inventors: Takayuki Kuronuma, Tokyo (JP); Yohei Oishi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 16/275,906

(22) Filed: Feb. 14, 2019

(65) Prior Publication Data

US 2019/0257319 A1 Aug. 22, 2019

(30) Foreign Application Priority Data

Feb. 20, 2018 (JP) ..... JP2018-027698

(51) Int. Cl.

| | |
|---|---|
| ***F04D 13/06*** | (2006.01) |
| ***F04D 29/40*** | (2006.01) |
| ***F04D 29/60*** | (2006.01) |
| ***F04D 13/02*** | (2006.01) |

(Continued)

(52) U.S. Cl.

CPC ..... *F04D 13/0666* (2013.01); *F04D 13/025* (2013.01); *F04D 13/0626* (2013.01); *F04D 29/026* (2013.01); *F04D 29/406* (2013.01); *F04D 29/5806* (2013.01); *F04D 29/588* (2013.01); *F04D 29/5866* (2013.01); *F04D 29/605* (2013.01)

(58) Field of Classification Search

CPC ..... F04D 29/406; F04D 29/548; F04D 29/42; F04D 29/586; F04D 29/5866; F04D 13/0666; F04D 13/024; F04D 13/025; F04D 13/0606; F04D 13/0613; F04D 13/0626

See application file for complete search history.

(56) References Cited

U.S. PATENT DOCUMENTS 2,782,721 A * 2/1957 White ..... H02K 5/1282 417/357
3,426,691 A * 2/1969 Anderson ..... F04D 13/0613 417/370

(Continued)

FOREIGN PATENT DOCUMENTS

JP 2544825 B2 10/1996
JP 2011-106323 * 6/2011 ..... F04D 13/06

OTHER PUBLICATIONS

MachinetranslationJP2011106323, Patent Translate , Espacenet.com, May 9, 2020; 9 pages. (Year: 2020).*

*Primary Examiner* — Bryan M Lettman
*Assistant Examiner* — Timothy P Solak
(74) *Attorney, Agent, or Firm* — Leydig, Voit and Mayer, Ltd.

(57) ABSTRACT

A motor pump capable of preventing deformation of a resin-made motor casing due to heat while securing a mechanical strength of the motor casing is disclosed. The motor pump includes a motor casing made of resin. The motor stator is disposed in the motor casing. The motor casing includes a partition wall located between the impeller and stator coils, ribs extending radially, and an inner frame connected to an inner edge of the partition wall. The partition wall is fixed to the ribs. The motor casing has guide protrusions formed on an outer surface of the inner frame, and further has recesses formed between the guide protrusions.

15 Claims, 11 Drawing Sheets

(51) Int. Cl.
*F04D 29/58* (2006.01)
*F04D 29/02* (2006.01)

(56) References Cited

U.S. PATENT DOCUMENTS

| | | | | |
|---|---|---|---|---|
| 3,513,942 | A * | 5/1970 | Tetsuya | F16J 15/40 184/6 |
| 2010/0158723 | A1* | 6/2010 | Ihle | H02K 11/33 417/423.7 |
| 2013/0259720 | A1* | 10/2013 | Mills | H02K 11/33 417/410.1 |

* cited by examiner

PUMP AND MOTOR CASING HAVING RIBS AND GUIDE PROTRUSIONS

CROSS REFERENCE TO RELATED APPLICATION

This document claims priority to Japanese Patent Application Number 2018-027698 filed Feb. 20, 2018, the entire contents of which are hereby incorporated by reference.

BACKGROUND

Japanese laid-open patent document No. 2544825 discloses a conventional example of a motor pump that rotates an impeller having permanent magnets embedded therein by a magnetic field generated by a motor stator. The motor pump described in this patent document 1 includes the impeller in which permanent magnets are embedded and the motor stator disposed so as to face the impeller. The impeller is rotatably supported by one spherical bearing. This spherical bearing is a so-called dynamic pressure bearing, and is configured to be able to tiltably support the impeller while rotatably supporting the impeller.

The motor stator has a plurality of stator coils. When three-phase currents are passed through these stator coils, a rotating magnetic field is generated. This rotating magnetic field acts on the permanent magnets embedded in the impeller to rotate the impeller. Electric leakage can occurs if a liquid, handled by the pump, comes into contact with the motor stator. Therefore, a motor casing is provided between the motor stator and the impeller, so that the motor casing prevents the liquid from entering the motor stator.

The rotating magnetic field, generated by the motor stator, acts on the permanent magnets of the impeller through the motor casing. If the motor casing is made of metal, an eddy current is generated in the motor casing as the rotating magnetic field passes, causing heat generation of the motor casing and reduction in motor efficiency.

Therefore, in order to prevent the generation of such eddy current, the motor casing is usually made of resin. The resin-made motor casing can maintain electrical insulation of the stator coil even when the stator coil is brought into contact with the motor casing. Therefore, there is an advantage that ground fault does not occur.

However, if the pump is used under conditions such that the liquid being pumped has a high temperature or the temperature of the motor casing varies largely, the motor casing will deform due to thermal expansion or contraction. In addition, the motor stator itself generates heat due to energization, which may cause deformation of the motor casing due to thermal expansion. Normally, a small gap is formed between the impeller and the motor casing. Therefore, if the motor casing deforms, the rotating impeller may come into contact with the motor casing.

SUMMARY OF THE INVENTION

According to an embodiment, there is provided a motor pump capable of preventing deformation of a resin-made motor casing due to heat while securing a mechanical strength of the motor casing.

Embodiments, which will be described below, relate to a motor pump including an impeller in which permanent magnets are embedded and a motor stator configured to generate a magnetic field that rotates the impeller.

In an embodiment, there is provided a motor pump comprising: an impeller having permanent magnets embedded therein; a pump casing in which the impeller is disposed; a motor stator having stator coils; and a motor casing made of resin, the motor stator being disposed in the motor casing, wherein the motor casing includes a partition wall located between the impeller and the stator coils, ribs extending radially, and an inner frame connected to an inner edge of the partition wall, the partition wall is fixed to the ribs; and the motor casing has guide protrusions formed on an outer surface of the inner frame, and further has recesses formed between the guide protrusions.

In an embodiment, the motor stator has an inner circumferential surface which is in contact with at least one of the guide protrusions.

In an embodiment, the recesses are filled with a potting material.

In an embodiment, the guide protrusions and the recesses are arranged at equal intervals around a central axis of the motor casing.

In an embodiment, the guide protrusions are connected to the ribs, respectively.

In an embodiment, the motor pump further comprises at least one return passage for returning a liquid that has been discharged from the impeller to a liquid inlet of the impeller through a gap between the impeller and the partition wall.

In an embodiment, the motor pump further comprises a heat radiating member made of a material having a thermal conductivity higher than that of the motor casing, the heat radiating member being in contact with the motor stator.

In an embodiment, the motor pump further comprises a cooling chamber through which a coolant can flow, the cooling chamber being secured to the heat radiating member.

In an embodiment, the motor pump further comprises a suction port coupled to a liquid passage formed in the motor casing, the suction port being made of metal, the heat radiating member being in contact with the suction port.

In an embodiment, the suction port includes a cylindrical shaft portion, the shaft portion has a threaded portion formed on an outer circumferential surface thereof, the motor casing has a screw groove, the threaded portion engages with the screw groove, and the heat radiating member is sandwiched between the suction port and the motor casing.

In an embodiment, the heat radiating member is made of metal or ceramic.

In an embodiment, the heat radiating member serves as a motor cover that closes a housing space in which the motor stator is disposed.

The above-described embodiments can provide the following advantages.

(1) The plurality of guide protrusions formed on the outer surface of the inner frame serve as reinforcing ribs, which can enhance the mechanical strength of the inner frame.

(2) The plurality of recesses that are formed between the plurality of guide protrusions can make the entirety of the inner frame thin. Therefore, the inner frame can efficiently dissipate the heat transmitted from the motor stator to a liquid contacting the motor casing. As a result, deformation of the motor casing due to heat can be prevented.

(3) Positioning of the inner circumferential surface of the motor stator is accomplished by the plurality of guide protrusions. Specifically, centering of the motor stator with respect to the motor casing is accomplished when the inner circumferential surface of the motor stator is fitted to the motor casing.

(4) The interior of the motor casing, including the plurality of recesses, is filled with the potting material. The recesses serve as flow paths for the potting material when filling the motor casing, and can therefore improve the flow of the potting material. As a result, a process of filling the motor casing with the potting material can be remarkably improved, and a process of checking the state of the potting material after filling the motor casing is facilitated. Furthermore, the potting material, filling the interior of the motor casing, functions not only as an electrically insulating material but also as a reinforcing material and a heat radiating material. Accordingly, the potting material can prevent deformation of the motor casing that can be caused by the heat.

DESCRIPTION OF EMBODIMENTS

Hereinafter, embodiments will be described in detail with reference to the drawings.

Figure 1:
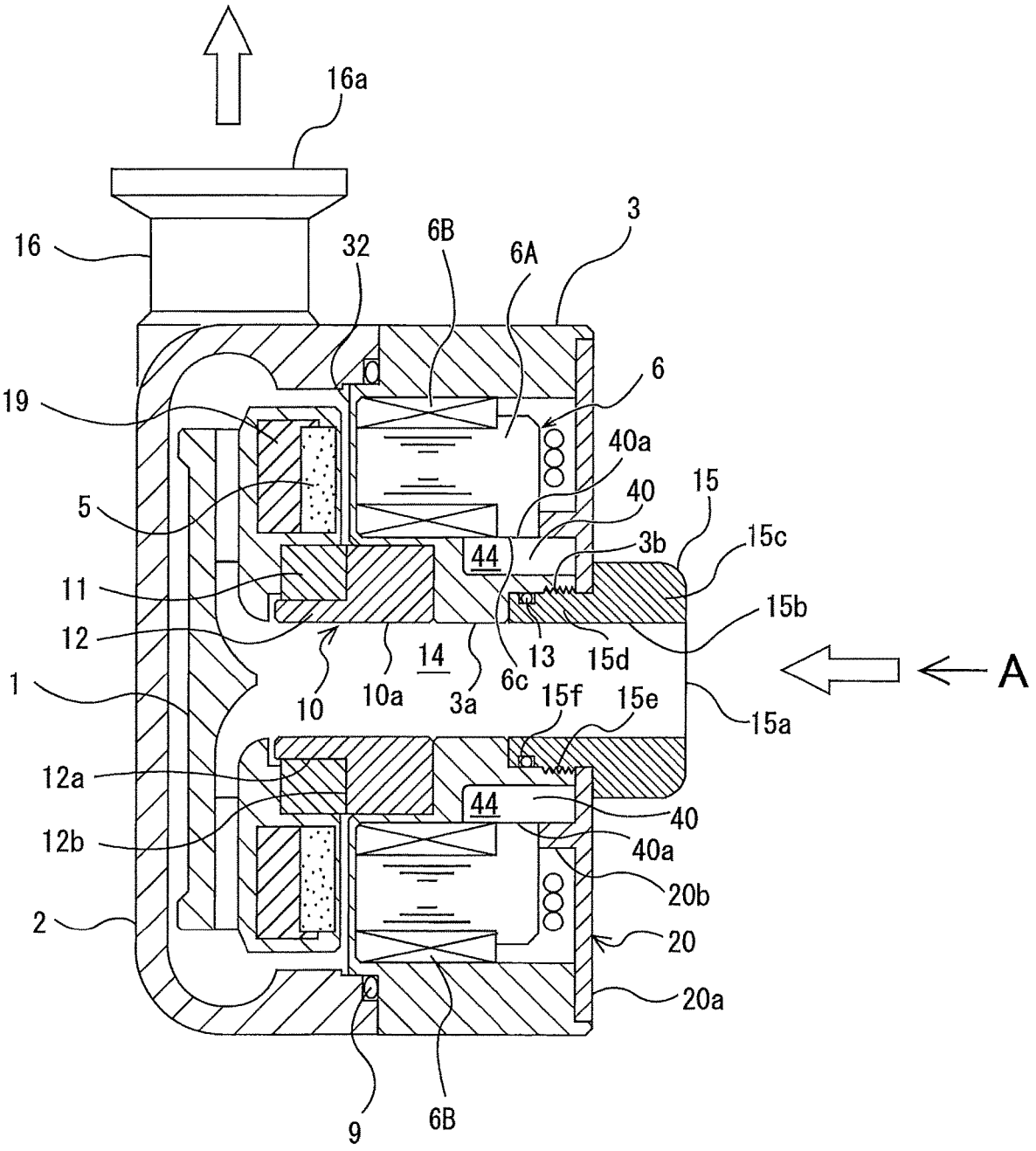
FIG. 1 is a cross-sectional view showing a motor pump according to an embodiment.
Figure 2:
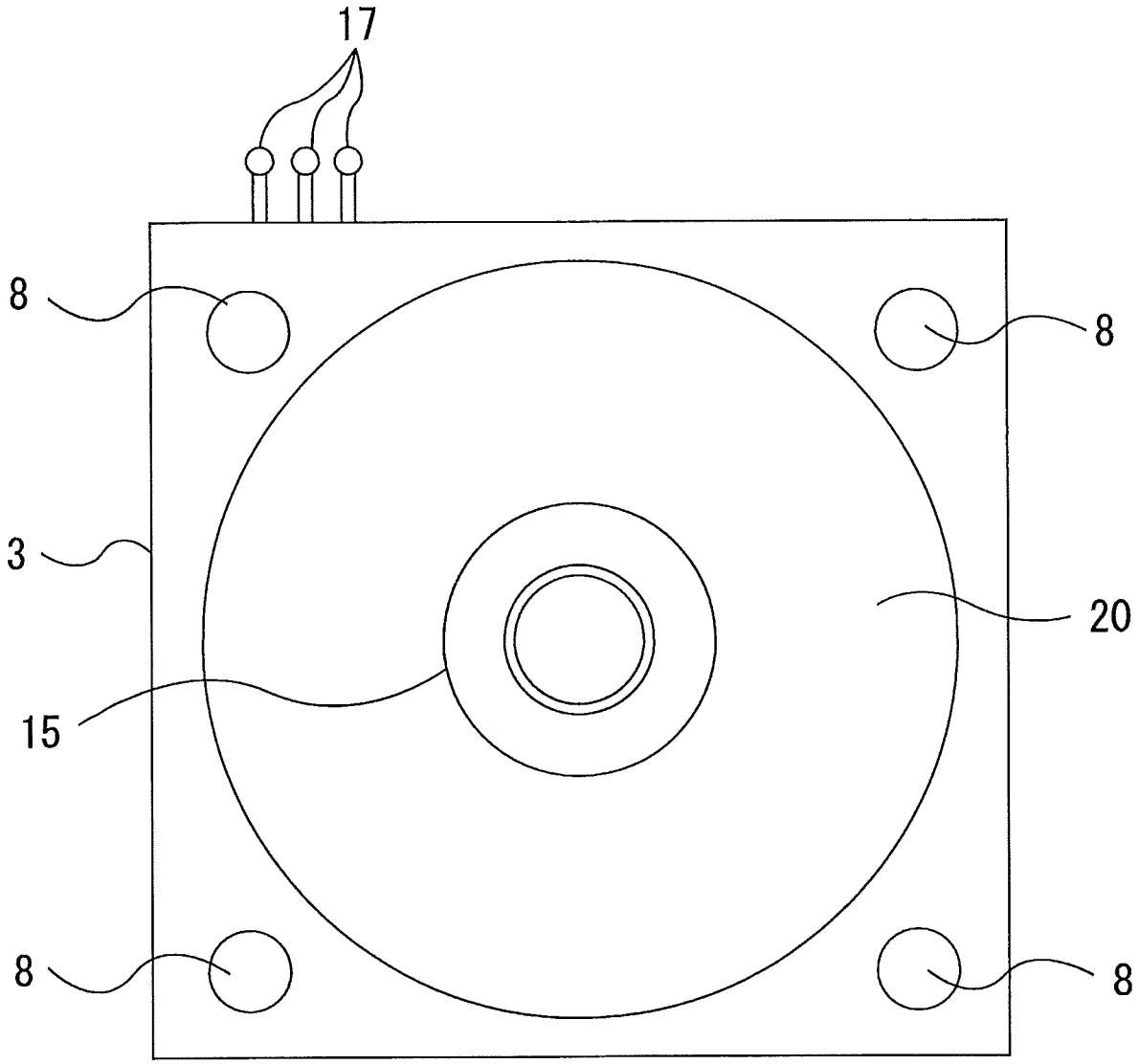
FIG. 2 is a view of the motor pump shown in FIG. 1 as viewed in a direction of arrow A.

FIG. 1 is a cross-sectional view showing a motor pump according to an embodiment, and FIG. 2 is a view showing the motor pump shown in FIG. 1 as viewed in a direction of arrow A. This motor pump includes an impeller 1 in which a plurality of permanent magnets 5 are embedded, a motor stator 6 for generating a magnetic force acting on these permanent magnets 5, a pump casing 2 in which the impeller 1 is disposed, a motor casing 3 in which the motor stator 6 is disposed, and a bearing 10 supporting a radial load and a thrust load of the impeller 1. The motor stator 6 and the bearing 10 are disposed at a suction side of the impeller 1.

The pump casing 2 and the motor casing 3 are fixed to each other by a plurality of coupling bolts 8 shown in FIG. 2. An O-ring 9 as a sealing member is provided between the pump casing 2 and the motor casing 3. The impeller 1 and the motor casing 3 are opposite each other with a small gap therebetween. A rotating magnetic field is generated by the motor stator 6, and acts on the permanent magnets 5 to thereby rotate the impeller 1. It is preferable that the gap between the impeller 1 and the motor casing 3 be as small as possible to an extent that the impeller 1 and the motor casing 3 do not come into contact with each other. Specifically, the gap may preferably be in a range of 0.5 mm to 1 mm.

The impeller 1 is rotatably supported by a single bearing 10. This bearing 10 is a sliding bearing (dynamic pressure bearing) utilizing dynamic pressure of liquid. This bearing 10 is constituted by a combination of a rotating-side bearing element 11 and a stationary-side bearing element 12 that loosely engage with each other. The rotating-side bearing element 11 is fixed to the impeller 1 and arranged so as to surround a liquid inlet of the impeller 1. The stationary-side bearing element 12 is fixed to the motor casing 3 and is disposed at a suction side of the rotating-side bearing element 11. The stationary-side bearing element 12 has a radial surface 12*a* for supporting the radial load of the impeller 1, and further has a thrust surface 12*b* for supporting the thrust load of the impeller 1. The radial surface 12*a* is parallel with a central axis of the impeller 1, and the thrust surface 12*b* is perpendicular to the central axis of the impeller 1.

The rotating-side bearing element 11 has an annular shape. The rotating-side bearing element 11 has an inner circumferential surface which faces the radial surface 12*a* of the stationary-side bearing element 12. The rotating-side bearing element 11 further has a side surface which faces the thrust surface 12*b* of the stationary-side bearing element 12. A small gap is formed between the inner circumferential surface of the rotating-side bearing element 11 and the radial surface 12*a*, and a small gap is formed between the side surface of the rotational side bearing element 11 and the thrust surface 12*b*. Spiral grooves (not shown) for generating dynamic pressure are formed in the inner circumferential surface and the side surface of the rotating-side bearing element 11.

A part of the liquid, discharged from the impeller 1, is introduced to the bearing 10 through a small gap between the impeller 1 and the motor casing 3. When the rotating-side bearing element 11 rotates together with the impeller 1, the dynamic pressure of liquid is generated between the rotating-side bearing element 11 and the stationary-side bearing element 12, whereby the impeller 1 is supported by the bearing 10. Since the stationary-side bearing element 12 supports the rotating-side bearing element 11 by the radial surface 12*a* and the thrust surface 12*b* that are orthogonal, a tilting motion of the impeller 1 is restricted by the bearing 10. The bearing 10 (the rotating-side bearing element 11 and the stationary-side bearing element 12) is formed of a material having excellent abrasion resistance, such as ceramic or carbon.

A suction port 15 having a suction opening 15*a* is coupled to the motor casing 3. This suction port 15 is made of a metal such as stainless steel, and is coupled to a suction line (not shown). Liquid passages 15*b*, 3*a*, 10*a* are formed in central portions of the suction port 15, the motor casing 3, and the bearing 10, respectively. These liquid passages 15*b*, 3*a*, 10*a* are coupled in a row to constitute one liquid passage 14 extending from the suction opening 15*a* to the liquid inlet of the impeller 1.

The suction port 15 has a cylindrical base portion 15*c* and a cylindrical shaft portion 15*d* having a smaller diameter than that of the base portion 15*c*. The base portion 15*c* and the shaft portion 15*d* constitute an integral structure, and the shaft portion 15*d* extends from the base portion 15*c* into the motor casing 3. Central axes of the base portion 15*c* and the shaft portion 15*d* coincide with the central axis of the suction port 15. The liquid passage 15*b* is formed by inner circumferential surfaces of the base portion 15*c* and the shaft portion 15*d*. The liquid passage 15*b* of the suction port 15 is coupled to the liquid passage 3*a* of the motor casing 3. A threaded portion 15*e* is formed on a part of an outer circumferential surface of the shaft portion 15*d*, and a screw groove 3*b* is formed in the motor casing 3. The suction port 15 is fixed to the motor casing 3 by engaging the threaded portion 15*e* of the suction port 15 with the screw groove 3*b* of the motor casing 3.

The threaded portion 15*e* is not formed on an outer circumferential surface of a distal-side of the shaft portion 15*d*. An annular groove 15*f* is provided in the outer circumferential surface of the shaft portion 15*d* where the threaded portion 15*e* is not formed. An O-ring 13 for sealing a gap between the motor casing 3 and the suction port 15 is disposed in this annular groove 15*f*.

A discharge port 16 having a discharge opening 16*a* is provided on the side surface of the pump casing 2. The liquid, pressurized by the rotating impeller 1, is discharged through the discharge opening 16*a*. The motor pump according to the present embodiment is a so-called end-top type motor pump having the suction opening 15*a* and the discharge opening 16*a* which are orthogonal to each other.

The impeller 1 is made of a non-magnetic material which is slippery and resistant to wear. For example, a resin, such as Teflon (registered trademark) or PPS (polyphenylene sulfide), or ceramic is preferably used. The pump casing 2 and the motor casing 3 can be formed of the same material as the impeller 1. The rotating-side bearing element 11 of the bearing 10 may be omitted, a spiral groove may be formed in a part of the impeller 1, and the impeller 1 may be supported by the radial surface 12*a* and the thrust surface 10*b* of the stationary-side bearing element 12.

Figure 3:
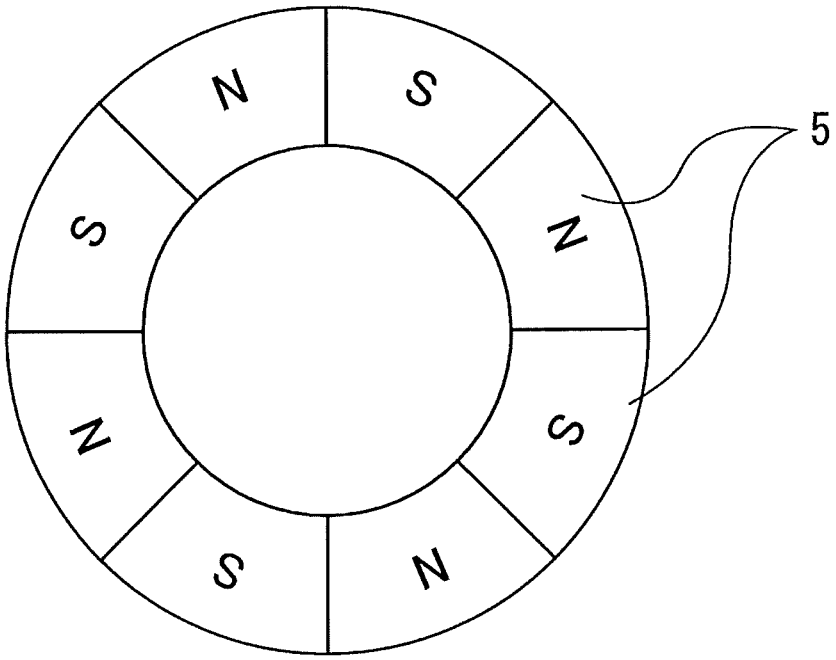
FIG. 3 is a plan view showing permanent magnets embedded in an impeller.

FIG. 3 is a plan view showing the permanent magnets 5 embedded in the impeller 1. As shown in FIG. 3, the plurality of permanent magnets 5 are arranged in a circle, and S poles and N poles are alternately arranged. Each of the permanent magnets 5 has a fan shape. In the present embodiment, the number of permanent magnets 5 is eight (i.e., eight poles). As shown in FIG. 1, an annular magnet yoke (or a magnetic body) 19 is embedded in the impeller 1 at a location adjacent to the plurality of permanent magnets 5. The permanent magnets 5 are located at the suction side of the magnet yoke 19. The permanent magnets 5 and the motor stator 6 are arranged so as to face each other, and the motor stator 6 is located at the suction side of the impeller 1. The motor stator 6 is disposed in the motor casing 3. A housing space in which the motor stator 6 is housed is closed by a heat radiating member 20. In the present embodiment, a plurality of permanent magnets 5 are provided, while the present invention is not limited to this embodiment, and a single permanent magnet in which a plurality of magnetic poles are magnetized may be used. Specifically, one annular permanent magnet having a plurality of magnetic poles including S poles and N poles which are alternately magnetized may be used.

Figure 4A:
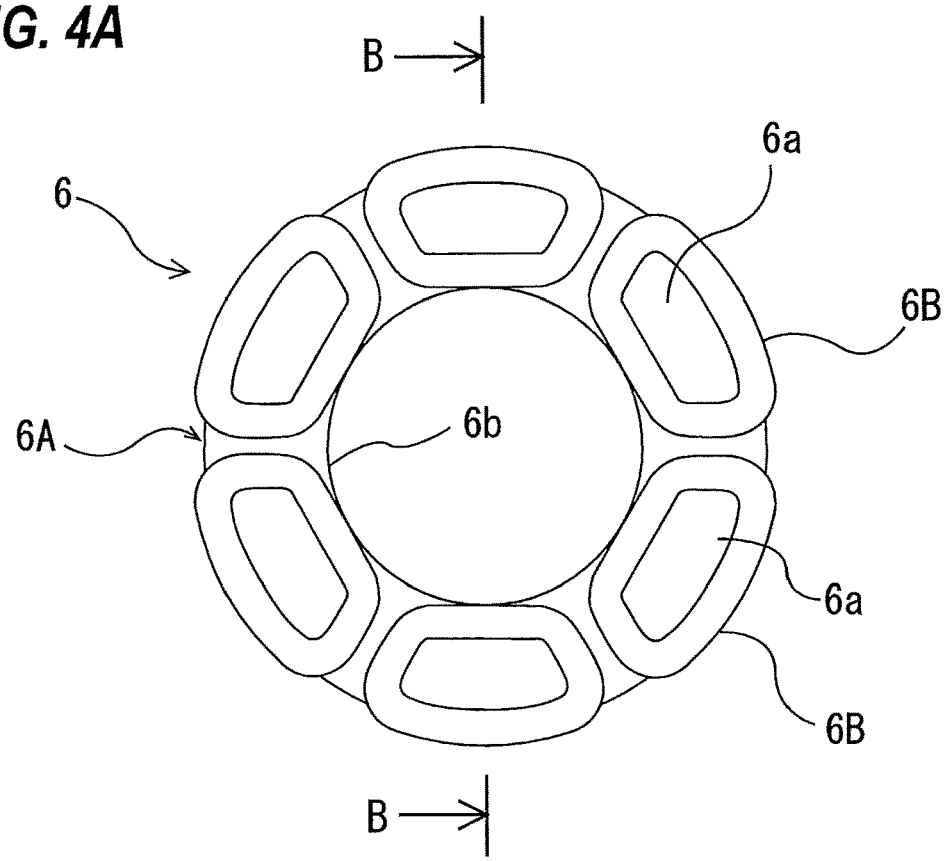
FIG. 4A is a plan view showing a motor stator.
Figure 4B:
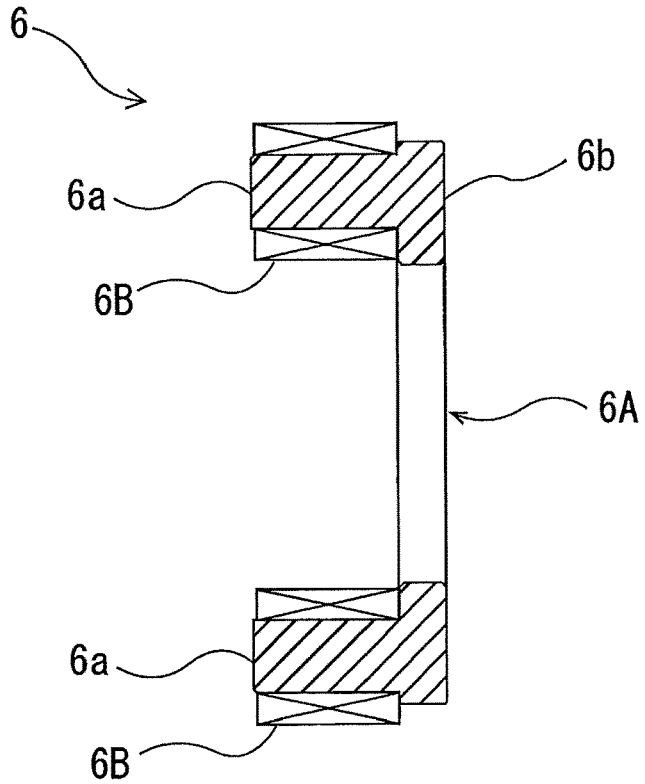
FIG. 4B is a cross-sectional view taken along line B-B shown in FIG. 4A.

FIG. 4A is a plan view showing the motor stator 6, and FIG. 4B is a cross-sectional view taken along line B-B shown in FIG. 4A. As shown in FIGS. 4A and 4B, the motor stator 6 includes a stator core 6A having a plurality of teeth 6*a* and a yoke portion 6*b*, and stator coils 6B wound around these teeth 6*a*, respectively. The yoke portion 6*b* is in an annular shape, and the teeth 6*a* are formed integrally with the yoke portion 6*b*. The teeth 6*a* are arranged at equal intervals on one surface of the yoke portion 6*b*. The teeth 6*a* and the stator coils 6B are arranged along the circumferential direction of the motor stator 6. In the present embodiment, the stator coils 6B are wound around six teeth 6*a*, respectively, and therefore the number of magnetic poles is six. The impeller 1 and the motor stator 6 are arranged concentrically with respect to the bearing 10 and the suction opening 15*a*.

Three lead wires 17 (see FIG. 2) are coupled to the stator coils 6B, and terminals of the lead wires 17 are coupled to a drive circuit (not shown). This drive circuit is a device that controls the timing of the current supplied to each of the stator coils 6B by using switching devices. More specifically, the drive circuit controls the timing of the current supplied to each of the stator coils 6B based on positions of the rotating permanent magnets 5. Methods of detecting the positions of the permanent magnets 5 include a method using a position sensor such as a hall element, a method utilizing a back electromotive force generated in the stator coils 6B without using a position sensor, and the like. The motor pump according to the present embodiment may employ either the sensor driving method using a position sensor or the sensorless driving method using no position sensor.

The above-described drive circuit is configured to appropriately switch the current application to the stator coils 6B based on the positions of the permanent magnets 5 to thereby rotate the permanent magnets 5, i.e., the impeller 1. When the impeller 1 rotates, the liquid is introduced through the suction opening 15*a* into the liquid inlet of the impeller 1. The liquid is pressurized by the rotation of the impeller 1 and is discharged through the discharge opening 16*a*. While the impeller 1 is delivering the liquid, the back surface of the impeller 1 is pressed toward the suction side (i.e., toward the suction opening 15*a*) by the pressurized liquid. The bearing 10, which is disposed at the suction side of the impeller 1, supports the thrust load of the impeller 1 from the suction side. According to the arrangement of the present embodiment, the single bearing 10 can support the radial load and the thrust load of the impeller 1 in a noncontact manner, a compact motor pump that does not generate particles can be realized.

Figure 5:
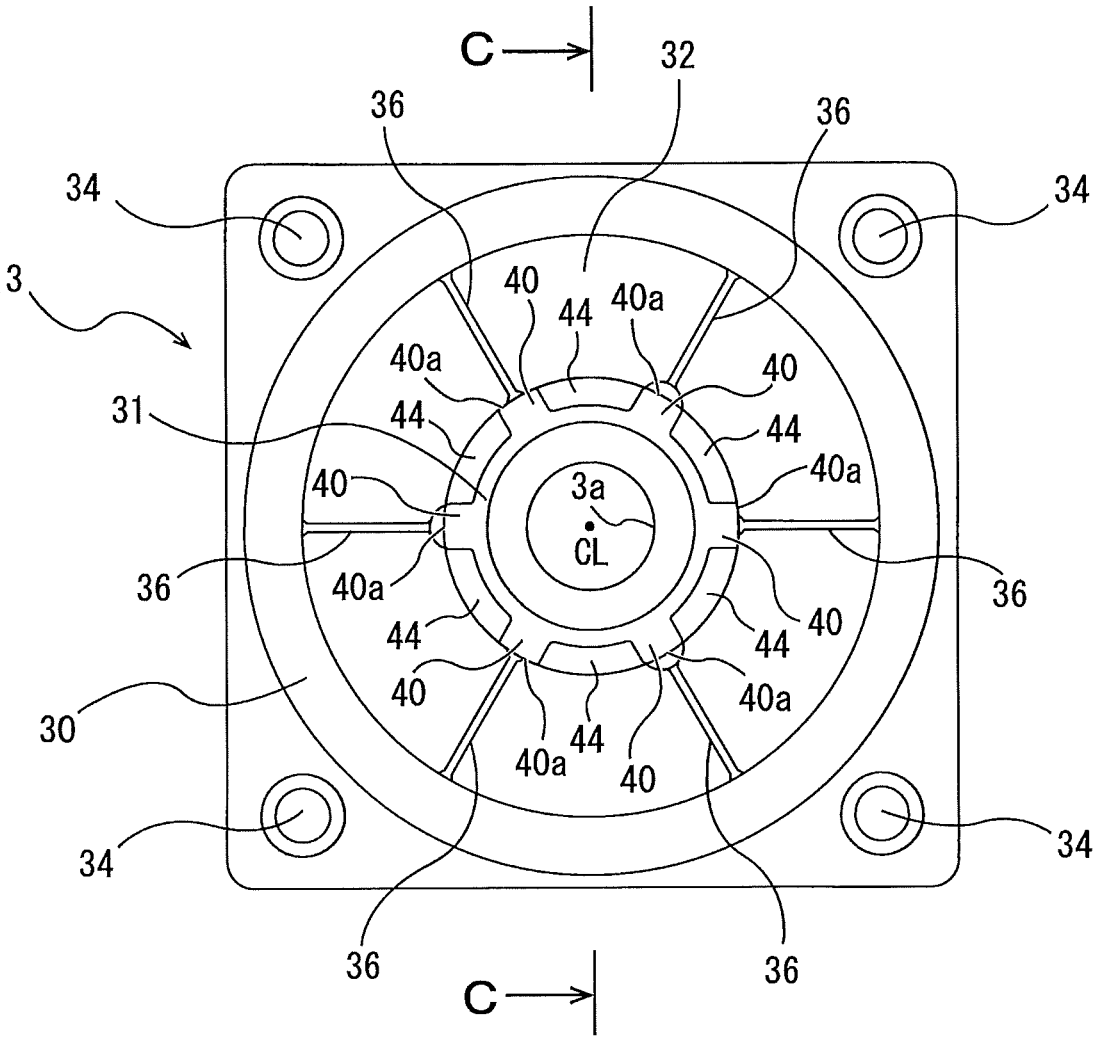
FIG. 5 is a plan view of a motor casing.
Figure 6:
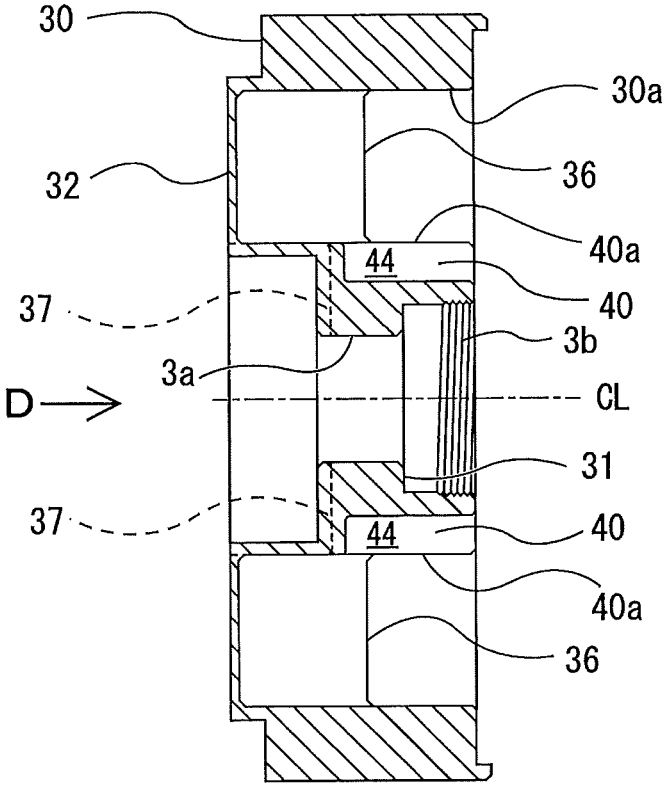
FIG. 6 is a cross-sectional view taken along line C-C shown in FIG. 5.

FIG. 5 is a plan view of the motor casing 3, and FIG. 6 is a cross-sectional view taken along line C-C shown in FIG. 5. The motor casing 3 includes an outer frame 30, an inner frame 31, and a partition wall 32 coupling the outer frame 30 and the inner frame 31. The inner frame 31 has the screw groove 3*b*, and the threaded portion 15*e* of the suction port 15 engages with the screw groove 3*b*. The outer frame 30 has a plurality of through-holes 34 into which the above-described coupling bolts 8 (see FIG. 2) are inserted, respectively. The inner frame 31 has substantially a cylindrical shape, and has the liquid passage 3*a* through which the liquid flows. The liquid passage 3*a* is formed in the central portion of the inner frame 31. The partition wall 32 has an annular shape. An inner edge of the partition wall 32 is connected to the inner frame 31, and an outer edge of the partition wall 32 is connected to the outer frame 30. The outer frame 30, the inner frame 31, and the partition wall 32 form the annular housing space in which the motor stator 6 is disposed.

The motor casing 3 further includes a plurality of ribs 36 fixed to the partition wall 32. These ribs 36 radially extend across the partition wall 32, and are arranged at equal intervals in the circumferential direction. Inner ends of the ribs 36 are fixed to the inner frame 31, and outer ends of the ribs 36 are fixed to the outer frame 30. The inner surface of the partition wall 32 is fixed to the radially extending ribs 36, so that the mechanical strength of the partition wall 32 is reinforced. The above-described housing space is partitioned into a plurality of segments by the ribs 36, and the stator coils 6B of the motor stator 6 are housed in these segments, respectively. The number of ribs 36 may preferably be the same as the number of stator coils 6B as in this embodiment. In this case, each rib 36 is arranged between the stator coils 6B.

A plurality of guide protrusions 40 are formed on an outer surface of the inner frame 31. These guide protrusions 40 are arranged at equal intervals around a central axis CL of the motor casing 3. In the present embodiment, each guide protrusion 40 extends in parallel with the central axis CL. Distances from the central axis CL of the motor casing 3 to outermost surfaces 40*a* of the plurality of guide protrusions 40 are the same. In the present embodiment, the number of guide protrusions 40 is the same as the number of ribs 36, and positions of the guide protrusions 40 in the circumferential direction of the motor casing 3 are also the same as positions of the ribs 36 in the circumferential direction of the motor casing 3. The guide protrusions 40 are connected to the ribs 36, respectively. More specifically, the inner ends of the ribs 36 are connected to the outermost surfaces 40*a* of the guide protrusions 40, respectively.

The guide protrusions 40 function as reinforcing ribs, which can increase the mechanical strength of the inner frame 31. In one embodiment, the number of guide protrusions 40 may be smaller than the number of ribs 36. From the viewpoint of ensuring the mechanical strength of the inner frame 31, it is preferable to provide at least two guide protrusions 40. A plurality of recesses 44 are formed between the plurality of guide protrusions 40. The guide protrusions 40 and the recesses 44 are alternately arranged around the central axis CL of the motor casing 3. The plurality of recesses 44 are also arranged at equal intervals around the central axis CL of the motor casing 3.

The outer frame 30, the inner frame 31, the partition wall 32, the ribs 36, and the guide protrusions 40 form an integral structure. From the viewpoint of ensuring electrical insulation of the motor stator 6 and preventing generation of eddy current, the motor casing 3 is made of a nonmetallic material. A resin is preferably used as a material constituting the motor casing 3. More specifically, inexpensive resin, such as PPS (polyphenylene sulfide) and PFA (tetrafluoroethylene-perfluoroalkyl vinyl ether copolymer) are used. The resin-made motor casing 3 has an advantage that the electrical insulation of the stator coils 6B is maintained even when the stator coils 6B come into contact with the motor casing 3, so that earth fault does not occur. Methods of forming the motor casing 3 with resin include injection molding.

The plurality of recesses 44, which are formed between the plurality of guide protrusions 40, can make the entire inner frame 31 thin. Therefore, the inner frame 31 can efficiently dissipate heat, transmitted from the motor stator 6, to the liquid flowing through the liquid passage 3*a* of the motor casing 3. As a result, deformation of the motor casing 3 due to heat can be prevented.

As shown in FIG. 1, an inner circumferential surface 6*c* of the motor stator 6 is in contact with the outermost surfaces 40*a* of the plurality of guide protrusions 40. According to such an arrangement, positioning of the motor stator 6 is accomplished by the plurality of guide protrusions 40. Specifically, centering of the motor stator 6 with respect to the motor casing 3, i.e., positioning of the motor stator 6 in the radial direction, is accomplished when the inner circumferential surface 6*c* of the motor stator 6 is fitted to the motor casing 3. Furthermore, since the outermost surfaces 40*a* of the plurality of guide protrusions 40 are in contact with the inner circumferential surface 6*c* of the motor stator 6, the heat generated by the stator coils 6B is efficiently transmitted to the motor casing 3, and is then transferred to the liquid flowing through the liquid passage 3*a* of the motor casing 3. A small gap may be formed between the inner circumferential surface 6*c* of the motor stator 6 and any one of the outermost surfaces 40*a*. Even in this case, since the other outermost surfaces 40*a* are in contact with the inner circumferential surface 6*c* of the motor stator 6, the positioning of the motor stator 6 in the radial direction can be achieved, and the heat generated by the stator coils 6B can be transmitted to the motor casing 3.

Figure 7:
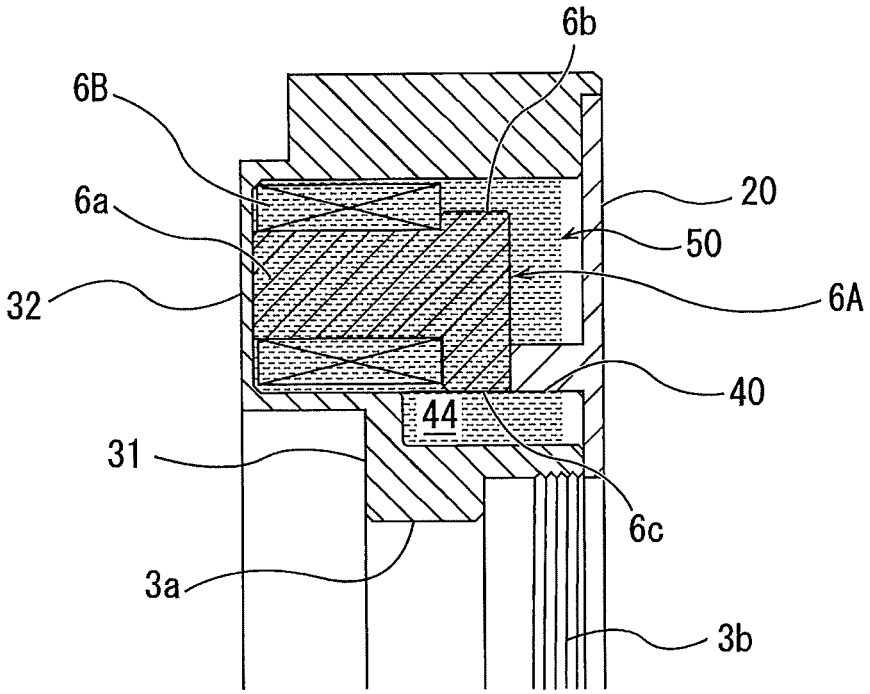
FIG. 7 is a schematic view showing a potting material filling the motor casing.

FIG. 7 is a schematic diagram showing a potting material 50 filling the motor casing 3. As shown in FIG. 7, the interior of the motor casing 3, including the plurality of recesses 44, is filled with the potting material 50. The stator core 6A and the stator coils 6B are covered with the potting material 50. The recesses 44 serve as flow paths for the potting material 50 when filling the motor casing 3, and can therefore improve the flow of the potting material 50. As a result, a process of filling the motor casing 3 with the potting material 50 can be remarkably improved, and a process of checking the state of the potting material 50 after filling the motor casing 3 is facilitated. Furthermore, the potting material 50, filling the interior of the motor casing 3, functions not only as an electrically insulating material but also as a reinforcing material and a heat radiating material. Accordingly, the potting material 50 can prevent deformation of the motor casing 3 due to heat. In FIG. 1, depiction of the potting material 50 is omitted.

As shown in FIG. 1, the partition wall 32 of the motor casing 3 faces the suction side surface of the impeller 1. Specifically, the partition wall 32 is located between the impeller 1 and the stator coils 6B, and has a function of partitioning off the gap between the impeller 1 and the motor stator 6. The rotating magnetic field generated by the motor stator 6 reaches the permanent magnets 5 of the impeller 1 through the partition wall 32. Therefore, it is preferable that the partition wall 32 of the motor casing 3 be as thin as possible. For example, the partition wall 32 of the motor casing 3 has a thickness of several millimeters.

The motor pump according to the present embodiment is used for delivering or circulating a liquid having a wide range of temperatures (for example, from −40° C. to 200° C.). During operation of the motor pump, the partition wall 32 of the motor casing 3 receives the heat generated by the motor stator 6. In addition, the partition wall 32 of the motor casing 3 is heated or cooled by contact with the liquid. Even under such operating conditions, thermal deformation of the partition wall 32 hardly occurs, because the partition wall 32 is reinforced by the plurality of ribs 36. Therefore, contact between the impeller 1 and the motor casing 3 during pump operation can be prevented.

Furthermore, each rib 36 is fixed not only to the partition wall 32 but also to the inner frame 31 and the outer frame 30. Therefore, the ribs 36 can increase the rigidity of the entire motor casing 3. Moreover, these ribs 36 not only serve as a reinforcing member of the motor casing 3 but also serve as an insulating member for ensuring electrical insulation between the adjacent stator coils 6B. Specifically, because the same number of ribs 36 as the stator coils 6B are provided, each rib 36 is sandwiched between the stator coils 6B, thus ensuring the electrical insulation between the stator coils 6B.

As shown in FIG. 1, the motor pump of this embodiment includes a heat radiating member 20 which is in contact with the stator core 6A of the motor stator 6 and the suction port 15. The heat radiating member 20 is made of a material having a thermal conductivity higher than that of the motor casing 3. Examples of such a material include metal, such as stainless steel or aluminum, and ceramic.

As shown in FIG. 1, the motor stator 6 is disposed in the housing space formed in the motor casing 3, and the housing space is closed by the heat radiating member 20 as shown in FIG. 1. Therefore, the heat radiating member 20 of the present embodiment serves as a motor cover that closes the housing space for the motor stator 6. The motor stator 6 is sandwiched between the motor casing 3 and the heat radiating member 20. The heat radiating member 20 includes a cover plate 20*a* that closes the housing space for the motor stator 6, and a fixing ring 20*b* that protrudes from a surface of the cover plate 20*a* toward the motor stator 6. The cover plate 20*a* and the fixing ring 20*b* are integrally formed. The cover plate 20*a* and the fixing ring 20*b* may be separate members. Also in this case, both the cover plate 20*a* and the fixing ring 20*b* are made of material having a higher thermal conductivity than the motor casing 3.

The entirety of the cover plate 20*a* is in a disk shape, and has a hole into which the suction port 15 is inserted. This hole is formed in the center of the cover plate 20*a*. The threaded portion 15*e* of the suction port 15 engages with the screw groove 3*b* of the motor casing 3. A part of the cover plate 20*a* of the heat radiating member 20 is sandwiched between the base portion 15*c* of the suction port 15 and the motor casing 3. In this state, the fixing ring 20*b* of the heat radiating member 20 is in contact with the stator core 6A of the motor stator 6, and presses the motor stator 6 against the partition wall 32 of the motor casing 3. In this manner, the heat radiating member 20 of the present embodiment contacts the stator core 6A and the suction port 15, and serves as a fixing member that fixes the position of the motor stator 6.

When a current is passed through the stator coils 6B of the motor stator 6, the stator coils 6B generate heat. A part of the heat is transferred to the liquid via the motor casing 3, and the other part is dissipated into the ambient air through the motor casing 3 and the heat radiating member 20. The heat generated by the motor stator 6 is transmitted to the heat radiating member 20 having a thermal conductivity higher than that of the motor casing 3 and is efficiently dissipated from the heat radiating member 20 into the ambient air.

The heat radiating member 20 is made of metal or ceramic. The reason why the heat radiating member 20 is made of metal or ceramic is to efficiently dissipate the heat generated by the motor stator 6 into the ambient air through the heat radiating member 20. Since the fixing ring 20*b* of the heat radiating member 20 is in contact with the motor stator 6, the heat of the motor stator 6 is transmitted to the heat radiating member 20 and is then dissipated from the heat radiating member 20 to the ambient air.

The heat radiating member 20 is in contact with the suction port 15. Since the suction port 15 is made of metal such as stainless steel, the suction port 15 has a high thermal conductivity. Therefore, the heat transmitted from the heat radiating member 20 to the suction port 15 is also efficiently dissipated into the ambient air from the suction port 15. Further, the suction port 15 is in contact with the liquid flowing in the liquid passage 15*b* of the suction port 15. Therefore, the heat transmitted to the suction port 15 is transmitted to the liquid flowing in the liquid passage 15*b*. As a result, the heat generated by the motor stator 6 can be dissipated more efficiently to the outside of the motor pump, so that the rise in the temperature of the motor stator 6 can be suppressed efficiently.

The inner circumferential surface of the fixing ring 20*b* of the heat radiating member 20 is in contact with the outermost surfaces 40*a* of the guide protrusions 40. Therefore, positioning of the heat radiating member 20 in the radial direction is achieved by the contact between the fixing ring 20*b* and the outermost surfaces 40*a* of the guide protrusions 40. A small gap may be formed between the inner circumferential surface of the fixing ring 20*b* and any one of the outermost surfaces 40*a*. Even in this case, the other outermost surfaces 40*a* can contact the inner circumferential surface of the fixing ring 20*b*, so that the radial positioning of the heat radiating member 20 is achieved.

Figure 8:
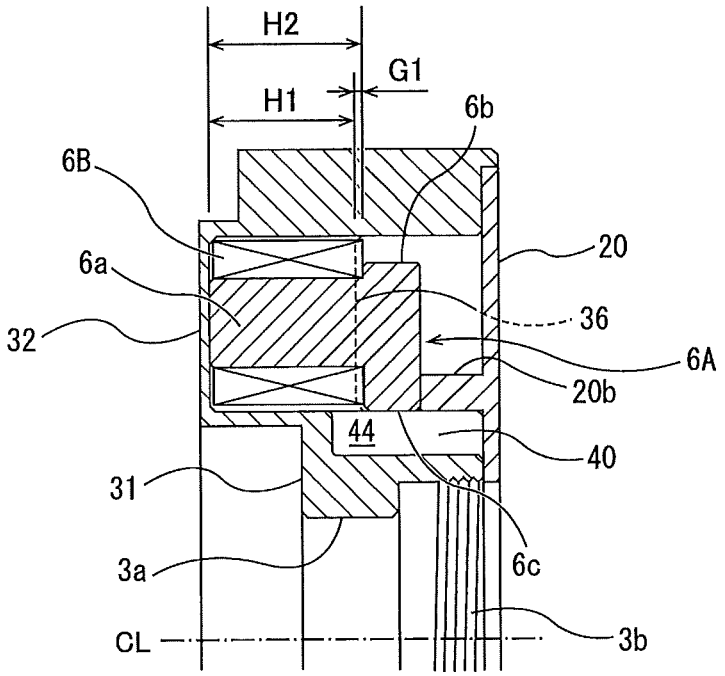
FIG. 8 is a partial cross-sectional view showing an example of dimensions of the motor casing and the motor stator.

FIG. 8 is a partial cross-sectional view showing an example of dimensions of the motor casing 3 and the motor stator 6. As shown in FIG. 8, a height H1 of the ribs 36 (a dimension of the ribs 36 along the central axis CL) is smaller than a height H2 of the teeth 6*a* of the stator core 6A (a dimension of the teeth 6*a* along the central axis CL). Therefore, the teeth 6*a* of the stator core 6A are in contact with the partition wall 32, while a small gap G1 is formed between the yoke portion 6*b* of the stator core 6A and the ribs 36. According to such a configuration, when the pressure of the liquid in the pump casing 2 rises, the partition wall 32, receiving the liquid pressure, is supported by the ribs 36 and also supported by the teeth 6*a*. In this manner, the partition wall 32 is supported from the motor side by both the ribs 36 and the teeth 6*a*, and therefore deformation of the partition wall 32 can be prevented.

Figure 9:
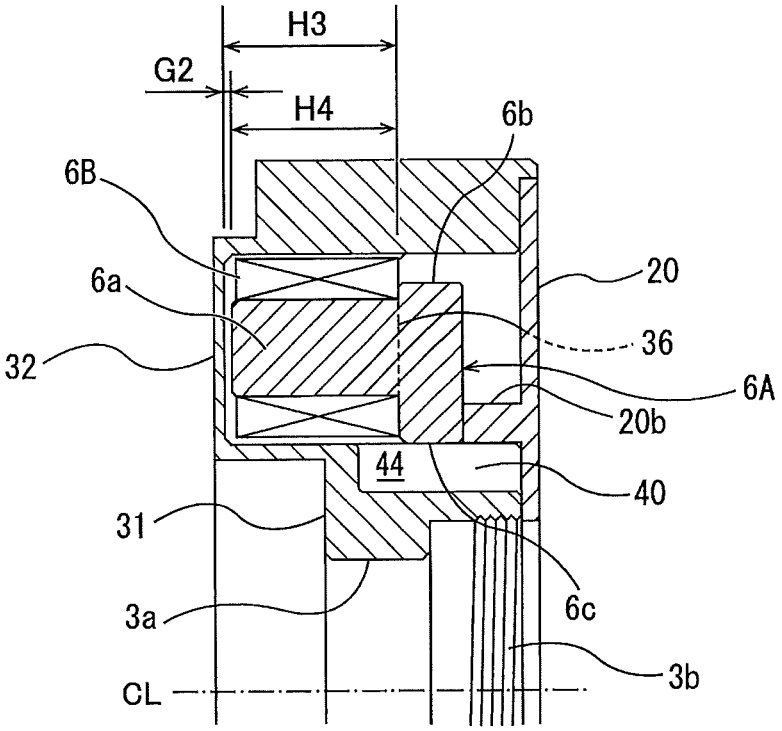
FIG. 9 is a partial cross-sectional view showing another example of dimensions of the motor casing and the motor stator.

FIG. 9 is a partial cross-sectional view showing another example of dimensions of the motor casing 3 and the motor stator 6. In this example, as shown in FIG. 9, a height H3 of the ribs 36 (a dimension of the ribs 36 along the central axis CL) is larger than a height H4 of the teeth 6*a* of the stator core 6A (a dimension of the teeth 6*a* along the central axis CL). Therefore, a small gap G2 is formed between the teeth 6*a* of the stator core 6A and the partition wall 32, while the yoke portion 6*b* of the stator core 6A is in contact with the ribs 36. According to such a configuration, when the pressure of the liquid in the pump casing 2 rises, the partition wall 32 is supported by the ribs 36 and is also supported by the yoke portion 6*b* of the stator core 6A through the ribs 36. In this manner, the partition wall 32 is supported from the motor side by both the ribs 36 and the yoke portion 6*b*, and therefore deformation of the partition wall 32 can be prevented.

Figure 10:
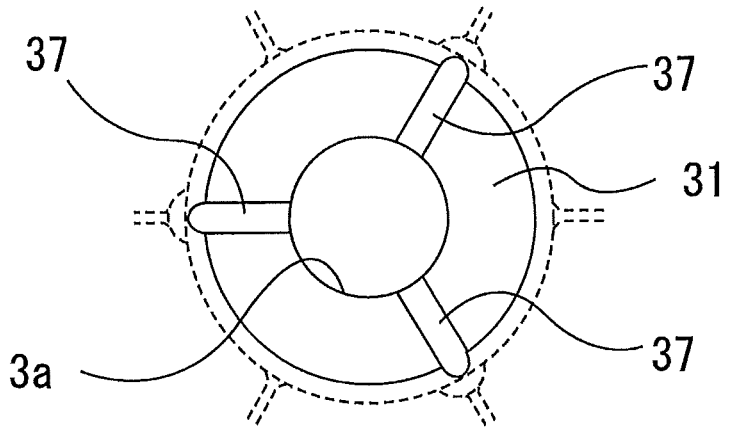
FIG. 10 is a view of a part of the motor casing shown in FIG. 6 as viewed in a direction of arrow D.

FIG. 10 is a view of a part of the motor casing 3 shown in FIG. 6 as seen from a direction indicated by an arrow D. As shown in FIG. 10, a plurality of (three in the present embodiment) return passages 37 are formed in the inner frame 31 of the motor casing 3. These return passages 37 are grooves formed in the inner surface of the inner frame 31. The return passages 37 are preferably located radially inwardly of the ribs 36. This is because fillet portions (thick portions) are provided at the end portions of the ribs 36 and it is possible to secure the strength of the motor casing 3 while forming the return passages 37 as grooves.

Figure 11:
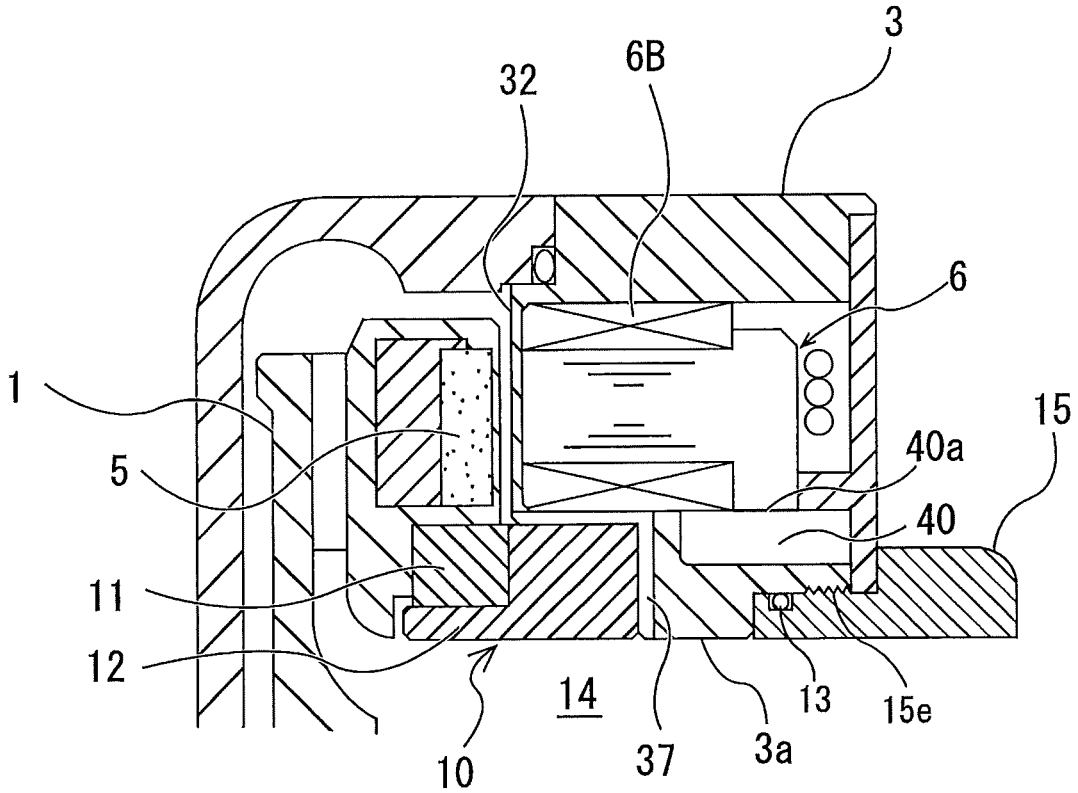
FIG. 11 is a cross-sectional view showing a return passage.

FIG. 11 is a cross-sectional view showing the return passage 37. As shown in FIG. 11, the return passage 37 extends from the gap between the impeller 1 and the partition wall 32 of the motor casing 3 to the liquid passage 14. Therefore, a part of the liquid pressurized by the impeller 1 flows through the gap between the impeller 1 and the partition wall 32 of the motor casing 3 and the return passage 37 in this order, and is returned to the liquid inlet of the impeller 1. A part of the liquid existing in the gap between the impeller 1 and the partition wall 32 enters the gap between the rotating-side bearing element 11 and the stationary-side bearing element 12 of the bearing 10 to generate the dynamic pressure necessary for supporting the impeller 1.

The return passages 37 are provided for supplying sufficient liquid to the bearing 10. If the liquid is not sufficiently present between the rotating-side bearing element 11 and the stationary-side bearing element 12 of the bearing 10, the bearing 10 may be burned. Particularly, when the liquid in the gap between the impeller 1 and the partition wall 32 boils due to the heat generation of the motor stator 6 or fluid friction, the liquid between the rotating-side bearing element 11 and the stationary-side bearing element 12 is depleted. In the present embodiment, the return passages 37 can always form the flow of liquid in the gap between the suction side surface of the impeller 1 and the partition wall 32. With the return passages 37, the evaporation of liquid due to the heat of the motor stator 6 can be suppressed, and the bearing 10 can generate a sufficient dynamic pressure for supporting the impeller 1.

Since the pump performance decreases with the increase in the number of return passages 37, the number of return passages 37 does not need to be the same as the number of ribs 36. In the present embodiment, three return passages 37 are provided while six ribs 36 are provided.

Figure 12:
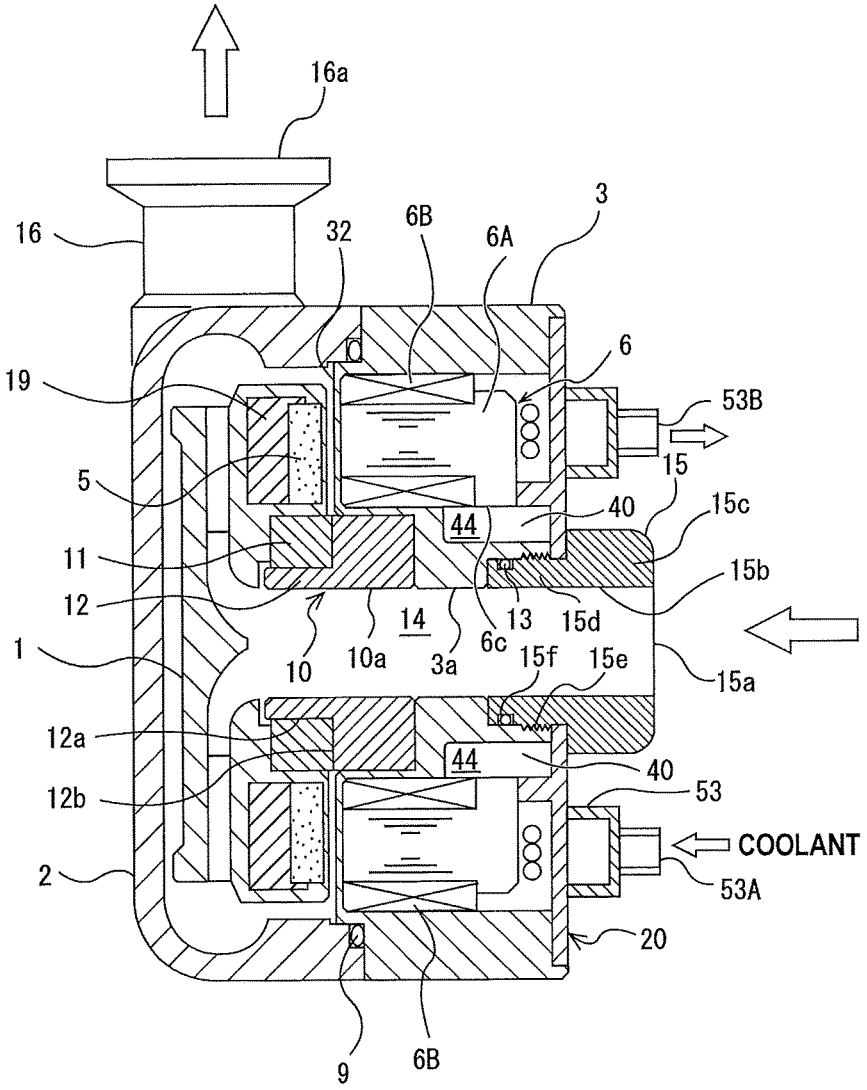
FIG. 12 is a cross-sectional view showing an embodiment in which a cooling chamber is provided on a heat radiating member serving as a motor cover.

In order to improve the cooling efficiency of the motor stator 6, as shown in FIG. 12, a cooling chamber 53 may be provided on the heat radiating member 20. FIG. 12 is a view showing a modified example in which the motor pump shown in FIG. 1 is provided with the cooling chamber 53. As shown in FIG. 12, the cooling chamber 53 is secured to the outer surface of the heat radiating member 20. The cooling chamber 53 has an annular shape and has a coolant inlet 53A and a coolant outlet 53B. A coolant (for example, cooling water) is supplied from a coolant supply source (not shown) into the cooling chamber 53 through the coolant inlet 53A, flows through the inside of the cooling chamber 53, and is discharged through the coolant outlet 53B. According to such a configuration, the heat generated by the motor stator 6 is transmitted to the coolant through the metallic heat radiating member 20, and therefore the heat of the motor stator 6 can be efficiently dissipated to the outside of the motor pump.

Figure 13:
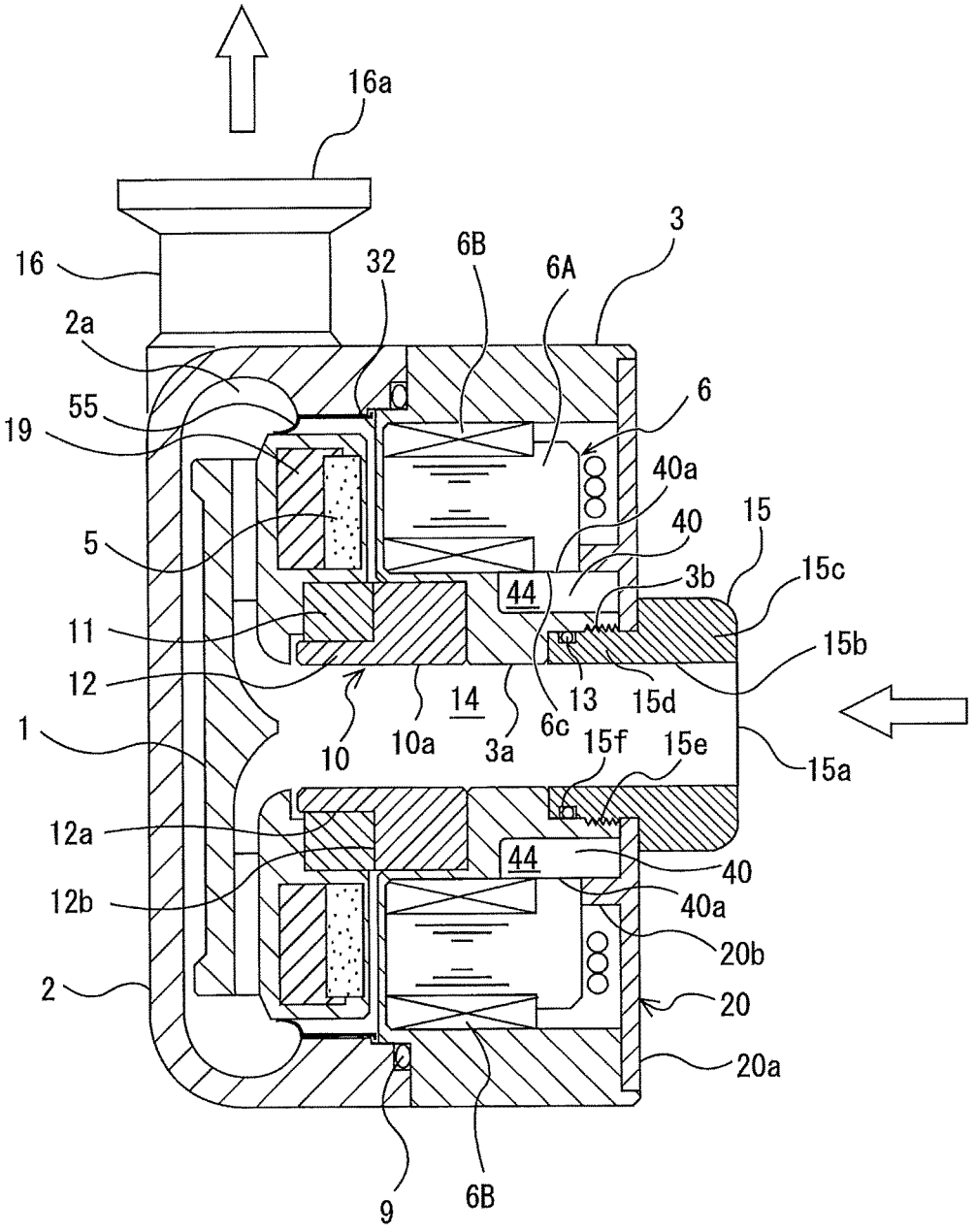
FIG. 13 is a cross-sectional view showing a motor pump according to another embodiment.

FIG. 13 is a cross-sectional view showing a motor pump according to another embodiment. Configurations of this embodiment, which will not specifically be described, are the same as those of the motor pump shown in FIG. 1, and duplicate explanations thereof will be omitted. If foreign matters, such as rust of a pipe and dirt, are contained in a liquid to be pumped, such foreign matters may enter the bearing 10 which is a dynamic pressure bearing, possibly causing damage to the bearing 10. Furthermore, if foreign matters made of magnetic material are contained in the liquid, such foreign matters accumulate on the surface of the impeller 1 having the permanent magnets 5 therein, and eventually the accumulated foreign matters come into contact with the partition wall 32 of the motor casing 3, thereby causing wear of the partition wall 32 and the impeller 1.

Figure 14:
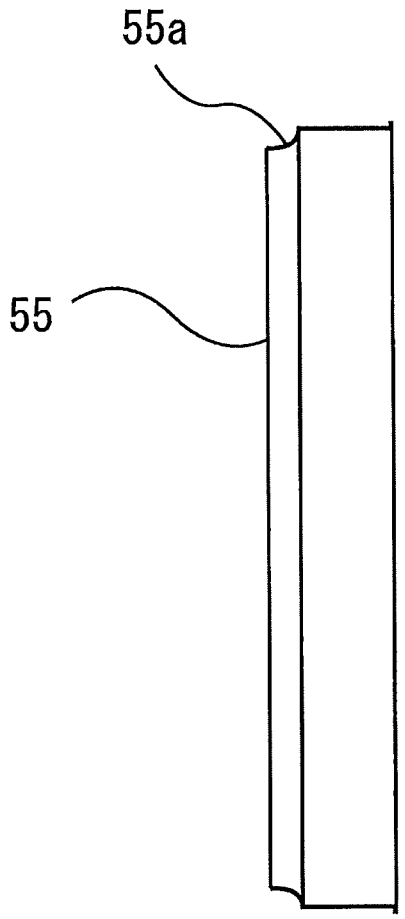
FIG. 14 is a cross-sectional view of a strainer shown in FIG. 13.

Therefore, a strainer 55 for removing foreign matter from the liquid is disposed between the outer circumferential surface of the impeller 1 and the inner circumferential surface of the motor casing 3. The strainer 55 is a filter made of a metal plate having a mesh formed therein. The mesh size is in a range of 1 μm to 100 μm, preferably in a range of 10 μm to 20 μm. FIG. 14 is a cross-sectional view of the strainer 55 shown in FIG. 13. The strainer 55 has an annular shape, and more specifically has a cylindrical shape having a short axial length. A distal end of the strainer 55 is bent radially inward to form a curved portion 50*a*. The curved portion 50*a* coincides with a position of a wall surface of a volute chamber 2*a* of the pump casing 2.

A gap through which the liquid flows is formed between the outer circumferential surface of the impeller 1 and the inner circumferential surface of the pump casing 2, and the strainer 55 is inserted into this gap. An outer circumferential surface of the strainer 55 is fitted to the inner circumferential surface of the pump casing 2, so that the position of the strainer 55 is fixed. The curved portion 50*a* of the strainer 55 is shaped so as to close the gap between the outer circumferential surface of the impeller 1 and the inner circumferential surface of the pump casing 2, so that foreign matter is removed by the strainer 55 from the liquid passing through the gap. The liquid that has passed through the strainer 55 is introduced to the bearing 10 through the gap between the impeller 1 and the partition wall 32 of the motor casing 3. Therefore, foreign matter does not enter the bearing 10, and the performance of the bearing 10 is maintained. Accordingly, the present embodiment can provide the motor pump capable of maintaining the performance of the bearing 10 by preventing foreign matter from entering the bearing (dynamic pressure bearing) 10 supporting the impeller 1.

The curved portion 50*a* of the strainer 55 has a curved cross section and has a shape that is smoothly connected to the wall surface of the volute chamber 2*a* of the pump casing 2. Further, the distal end of the curved portion 50*a* is located close to the outer circumferential surface of the impeller 1. Specifically, the strainer 55 extends from the wall surface of the volute chamber 2*a* to the outer circumferential surface of the impeller 1, and the entirety of the curved portion 50*a* is shaped so as to smoothly connect the wall surface of the volute chamber 2*a* to the outer circumferential surface of the impeller 1. Most of the liquid discharged from the impeller 1 rotates at a high speed in the circumferential direction along the volute chamber 2*a* and the strainer 55 by centrifugal force. The foreign matter once captured by the strainer 55 is washed out by the flow of the liquid, and is discharged together with the liquid through the discharge opening 16*a*. Therefore, the mesh of the strainer 55 is hardly clogged with foreign matters, and the maintenance of the strainer 55 is unnecessary. Further, since the curved portion 50*a* of the strainer 55 having the above-described shape constitutes an extended portion of the wall surface of the volute chamber 2*a*, a turbulent flow of the liquid in the volute chamber 2*a* is suppressed, and the pump performance is improved.

The motor pump described with reference to FIGS. 1 to 14 is a so-called end-top type motor pump having the suction opening and the discharge opening which are orthogonal to each other. The present invention is also applicable to an inline type motor pump having a suction opening, a discharge opening, and an impeller which are aligned in a straight line.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A motor pump comprising:

an impeller having permanent magnets embedded therein;

a pump casing in which the impeller is disposed;

a motor stator having stator coils; and a motor casing made of resin, the motor stator being disposed in the motor casing, wherein the motor casing includes a partition wall located between the impeller and the stator coils, an inner frame connected to a radially inner edge of the partition wall, and ribs extending radially outwardly from the inner frame along the partition wall, the partition wall is attached to the ribs; and the motor casing has guide protrusions protruding radially outwardly from a radially outer surface of the inner frame, and further has recesses formed between the guide protrusions.

2. The motor pump according to claim 1, wherein the motor stator has an inner circumferential surface which is in contact with at least one of the guide protrusions.

3. The motor pump according to claim 1, wherein the recesses are filled with a potting material.

4. The motor pump according to claim 1, wherein the guide protrusions and the recesses are arranged at equal intervals around a central axis of the motor casing.

5. The motor pump according to claim 1, wherein the guide protrusions are connected to the ribs, respectively.

6. The motor pump according to claim 1, further comprising at least one return passage for returning a liquid that has been discharged from the impeller to a liquid inlet of the impeller through a gap between the impeller and the partition wall.

7. The motor pump according to claim 1, further comprising a heat radiating member made of a material having a thermal conductivity higher than that of the motor casing, the heat radiating member being in contact with the motor stator.

8. The motor pump according to claim 7, further comprising a cooling chamber through which a coolant can flow, the cooling chamber being secured to the heat radiating member.

9. The motor pump according to claim 7, further comprising a suction port coupled to a liquid passage formed in the motor casing, the suction port being made of metal, the heat radiating member being in contact with the suction port.

10. The motor pump according to claim 9, wherein:

the suction port includes a cylindrical shaft portion;

the shaft portion has a threaded portion formed on an outer circumferential surface thereof;

the motor casing has a screw groove;

the threaded portion engages with the screw groove; and the heat radiating member is sandwiched between the suction port and the motor casing.

11. The motor pump according to claim 7, wherein the heat radiating member is made of metal or ceramic.

12. The motor pump according to claim 7, wherein the heat radiating member serves as a motor cover that closes a housing space in which the motor stator is disposed.

13. The motor pump according to claim 1, wherein the guide protrusions are located radially inwardly of the ribs.

14. The motor pump according to claim 1, wherein the recesses are located radially inward of the ribs.

15. The motor pump according to claim 1, wherein the inner frame has a radially inner surface that forms a liquid passage.

* * * * *